United States Patent [19]

Costa et al.

[11] Patent Number: 4,947,879

[45] Date of Patent: Aug. 14, 1990

[54] CONTAINER FOR FLUENT MATERIAL

[75] Inventors: Allan Costa, Old Westbury, N.Y.; Roger Costa, Somerset, Mass.

[73] Assignee: Empire Plastic Packaging, Ltd., Farmingdale, N.Y.

[21] Appl. No.: 334,323

[22] Filed: Apr. 7, 1989

[51] Int. Cl.[5] ..... A45D 40/30

[52] U.S. Cl. ..... 132/218; 132/216; 401/122; 401/129; 215/252; 215/253; 215/363

[58] Field of Search ..... 132/216, 218, 313, 317; 401/121, 122, 126, 129; 215/252, 253, 364

[56] References Cited

U.S. PATENT DOCUMENTS 4,189,245 2/1980 Bennett ..... 401/126
4,712,936 12/1987 Kessler ..... 401/126
4,733,784 3/1988 Bennett ..... 401/122
4,794,936 1/1989 Zango ..... 132/320

*Primary Examiner*—John J. Wilson
*Assistant Examiner*—Frank A. LaViola, Jr.
*Attorney, Agent, or Firm*—Leitner, Greene & Christensen

[57] ABSTRACT

A cosmetic container is provided with an annular lip within the container neck by a method which involves providing a closure for the container which has moulded integrally therewith a lip-forming member. When the closure is fitted to the container, the member forms an interference fit with the inner wall of the container and is retained when the closure is removed. An applicator wand on the closure extends through the annular member and the member acts as a wiper for the wand.

11 Claims, 1 Drawing Sheet

CONTAINER FOR FLUENT MATERIAL

FIELD OF THE INVENTION

This invention relates generally to the manufacture of containers for fluent materials such as cosmetic products. More particularly, the invention is concerned with a technique for providing an annular lip within the container neck, e.g. for use as a wiper for a cosmetic applicator wand.

BACKGROUND OF THE INVENTION

Containers for cosmetic products such as mascara, eyeliner and the like traditionally have a built-in applicator wand, for example in the form of a narrow, elongate brush. Typically, the wand is attached to a closure for the container so that the wand fits within the container when the closure is in place. To apply the cosmetic, the closure is removed from the container, bringing with it the wand and a certain amount of the cosmetic, carried on the wand. An annular lip is provided within the container neck to act as a wiper against which the wand is drawn as it is removed from a container so that excess amounts of the cosmetic are removed from tho wand.

DESCRIPTION OF THE PRIOR ART

Conventional practice is to make the container and wiper as separate plastic mouldings. For example, the container may be a plastic cylinder with a closed lower end and a threaded neck at its upper end. The wiper moulding takes the form of a tapered sleeve that fits within the neck of the container. The sleeve has a flange at its outer end that rests against the top surface of the container neck and the sleeve is of a length selected so that its inner end is located within the container below the threaded neck portion. The sleeve tapers towards its inner end and the sleeve opening at that end is dimensioned so that an appropriate amount of the cosmetic product will be wiped from the wand as it is withdrawn through the sleeve.

Usually, the wiper moulding is inserted into the container neck, after the container has been filled with cosmetic product. However, the wiper moulding can be placed onto the wand and fitted into the container by screwing the closure onto the container neck.

It will be appreciated that formation of the wiper as a separate moulding involves significant capital cost in that a specific mould must be provided for forming the wiper. There is also significant material cost and some cost in assembling the wiper moulding to the container.

SUMMARY OF THE INVENTION

An object of the present invention is to provide an improved method of forming an annular lip within a container neck which avoids at least some of these costs. A further aim is to provide an improved container/closure combination.

The method of the invention involves providing (a) a container having an annular neck portion with an inner wall and (b) a closure for the neck portion. The closure includes a plug which is adapted to fit within the container neck portion and an outer closure portion which remains external to the container when tho closure is in place. An annular lip-forming member is provided at the inner end of the plug and is joined to the plug by breakable coupling means. The closure is dimensioned with respect to the container neck portion so that the lip-forming member forms an interference fit with the inner wall of the container neck portion when the plug is fully seated within that portion. The coupling means is breakable, for example, by twisting of the closure so that the closure can be removed from the container while leaving the lip-forming member fitted within the container neck portion.

In other words, the lip-forming member initially forms part of the closure and is dimensioned to frictionally jam inside the container neck portion when the closure is fitted to the container and to break away from the closure as the closure is subsequently twisted for removal from the container. Conveniently, the closure is a one-piece plastic moulding which initially includes the lip-forming member only a single mould is then needed to form both the closure and the lip. Where the container is a cosmetic container, the lip of course forms the wiper discussed previously. The wand may also be moulded in one piece with the closure. In this way, the complete container/closure combination can be made using only two moulds. Where the wand is required to include a brush, the brush can be made separately and the one-piece closure and wand moulded onto the brush stem as a single operation.

The lip or wiper is installed in the container by simply fitting the closure to the container and then twisting or otherwise manipulating the outer closure portion to break the coupling means between the lip-forming member and the remainder of the closure. The twisting action can be effected immediately after the container has been filled and the closure fitted to the container. Alternatively, the consumer can be provided with instructions to twist the closure before the container is used.

The invention also provides the combination of a container which includes an annular neck portion having an inner wall and a closure for the container, the closure including a plug which fits within the container neck portion, an outer closure portion which remains external to the container, an annular lip-forming member at an inner end of the pug, and breakable coupling means between the lip-forming member and the plug. The closure is dimensioned so that the lip-forming member is an interference fit with the inner wall of the container neck portion when the plug is fully seated within the neck portion so that the lip-forming member can be separated from the closure and remain within the container when the closure is removed.

BRIEF DESCRIPTION OF THE DRAWINGS

In order that the invention may be more clearly understood, reference will now be made to the accompanying drawings which illustrate a particular preferred embodiment of the invention by way of example, and in which.

DESCRIPTION OF THE PREFERRED EMBODIMENT

Figure 1:
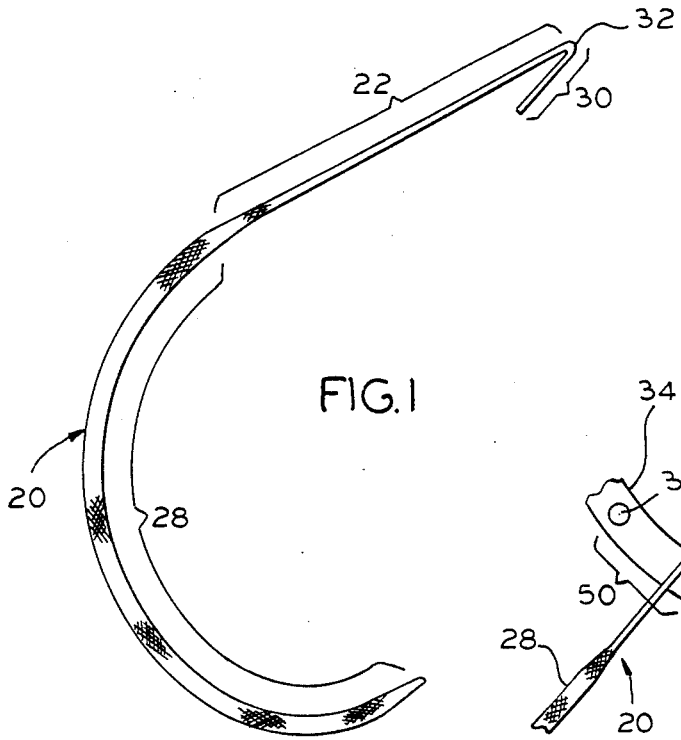
FIG. 1 is a perspective view of a container for mascara and an associated closure and wand in accordance with the invention, showing the closure and wand positioned above the container prior to insertion therein.

In the drawings, a mascara container is generally indicated by reference numeral 20 and a closure for the container is indicated at 22. A wand 24 extends downwardly from the closure for insertion into the container as indicated by arrow 26.

Container 20 is an injection moulded, clear plastic cylinder having a closed lower end 28 and an open upper end 30 with a neck portion 32 adjacent end 30. An annular inner wall of neck portion 32 is indicated at 34. A quantity of mascara within the container is shown at 36.

Figure 2:
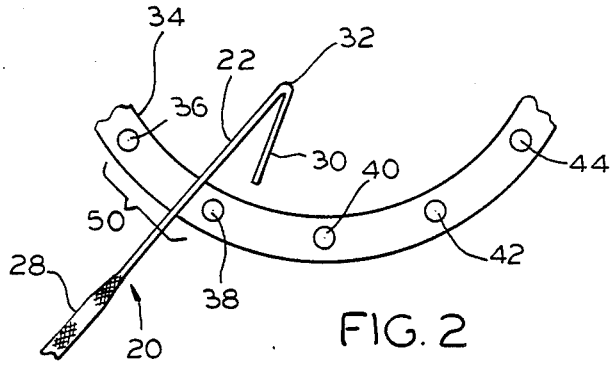
FIG. 2 is a view similar to FIG. 1 showing the closure and container assembled.
Figure 4:
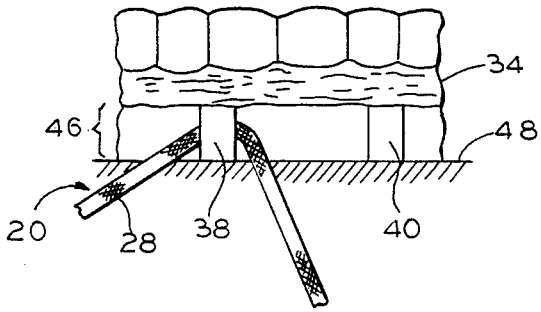
Figures 1, 2, 2A, 3:
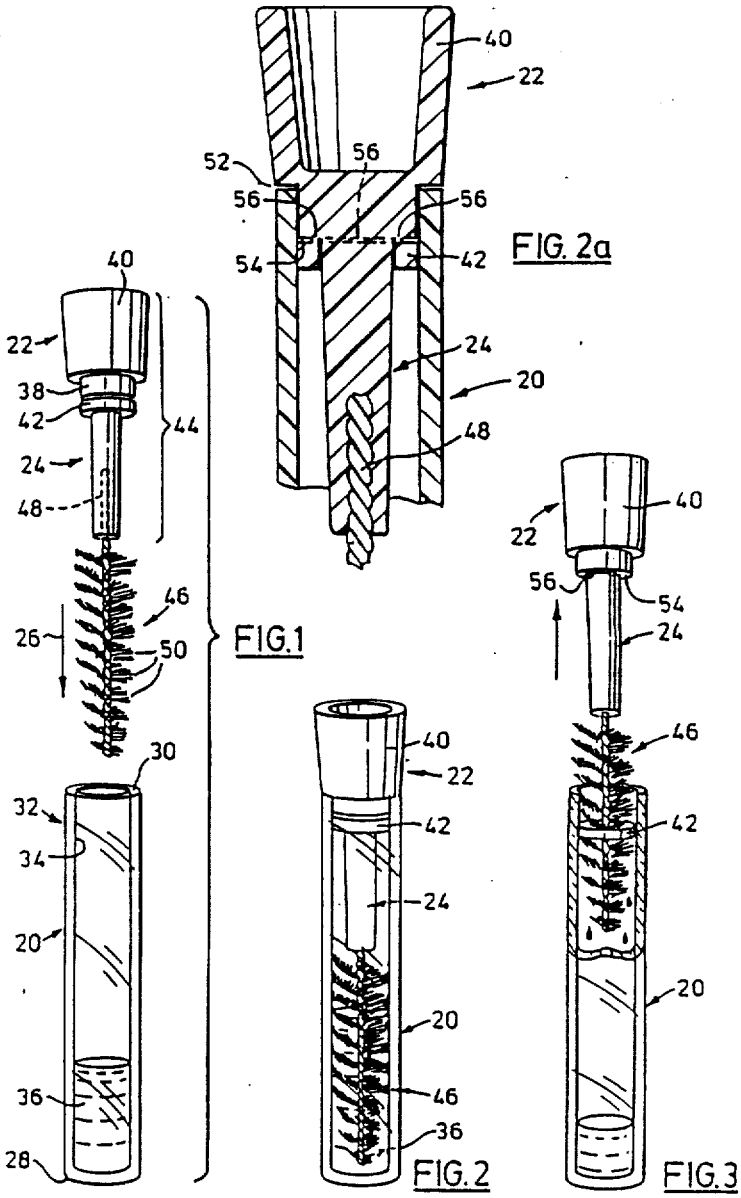
FIG. 2*a* is an enlarged vertical sectional view of the upper part of FIG. 2; and, FIG. 3 is a view similar to FIG. 1 showing the wand being withdrawn from tho container.

Closure 22 includes a plug 38 that is shaped to fit closely within the container neck portion 32 (as best seen in FIG. 2*a*), an outer closure portion 40 which remains external to the container when the closure is in place, and an annular lip-forming member 42 at the inner end of the plug 38. These elements (together forming closure 22), and wand 24 are a one-piece plastic moulding 44, as best seen in FIG. 2*a*. Wand 24 also includes a brush 46 of the type conventionally used for applying mascara. Brush 46 is made up of a wire stem 48 spirally wrapped around an array of bristles 50. Moulding 44 is formed on an exposed inner end portion of stem 48 (see FIG. 1).

Referring now more particularly to FIG. 2*a*, closure 20 is shown in that view with plug 38 fully seated within the neck portion 32 of container 20. Plug 38 is cylindrical and is shaped to fit closely within the container neck portion 32. The outer end portion 40 of the closure is of tapered cylindrical form and is of slightly larger diameter than the plug 38, defining a shoulder 52 that abuts against the top edge of the container when the closure is fully seated on the container.

Wand 24 is also of tapered cylindrical shape and is in effect formed as a narrower continuation of plug 38, again as best seen in FIG. 2*a*. Thus, wand 24 adjoins plug 38 at shoulder 54.

When moulding 44 is initially formed, the lip-forming member 42 is moulded as a plastic ring which encircles wand 24 adjacent to plug 38 and which is coupled to the shoulder 54 (FIG. 2*a*) on plug 38 by breakable coupling means. In the illustrated embodiment, these breakable coupling means take the form of four relatively thin and fragile plastic "gates" or "lands" that extend between lip 42 and shoulder 54. The gates are equally spaced around shoulder 54. Three of the four gates are visible in FIG. 2*a* and are denoted by reference numeral 56.

Closure 22 is dimensioned with respect to the container neck portion 32 so that the lip-forming member 42 forms an interference fit with the inner wall 34 of the container neck portion 32, when closure 22, and in particular plug 38 are fully seated on the container. More specifically, in accordance with established plastic moulding techniques, container 20 is moulded so that the container side wall tapers slightly towards its bottom end 28. The taper is very slight and is essentially not discernable to the eye, but is necessary in order to permit release from within the container of the mandrel used during the plastic moulding operation to form the inner wall of the container. Closure 22 is then dimensioned precisely so that, as it enters the open end of the container with plug 38, the member 42 will in effect jam against wall 34 when closure 22 reaches its fully seated position. This is the position shown in FIGS. 2 and 2*a*.

Figure 3:
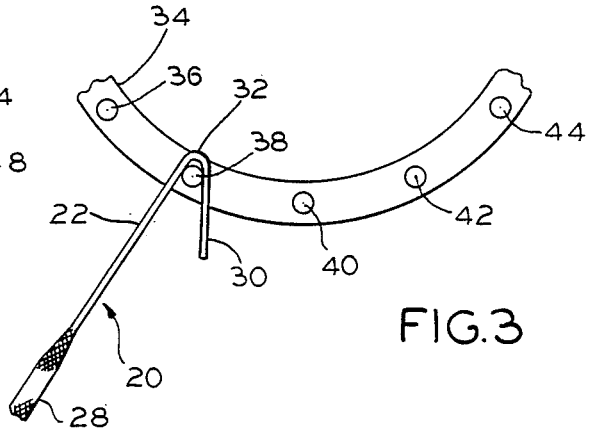
Figure 5:
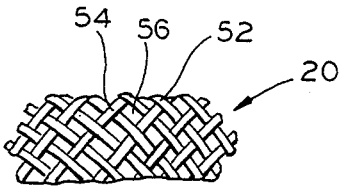

FIG. 1 shows the closure as moulded with member 42 coupled to plug 38. Once the plug has been fully seated within the container as shown in FIGS. 2 and 2*a*, the closure is twisted by manually turning outer portion 40 causing the coupling gates 56 to break so that member 42 becomes separate from the remainder of the closure. The closure can then be withdrawn, bringing with it the wand 24 as best shown in FIG. 3. Member 42 will remain within the neck portion 32 of the container and will act as a wiper for removing excess mascara from the bristles of the brush 46. It has been found in practice that member 42 remains in the container despite repeated movements of brush 46 back and forth through member 42.

Separation of closure 22 from member 42 is preferably performed by twisting as described, in order to ensure clean separation and avoid the risk of dislodgement of the member. However, it is conceivable that the member and closure could be separated simply by pulling on the closure.

In any event, it will be appreciated that, as compared with the prior art, a container and closure of the form provided by the invention can be manufactured relatively inexpensively using only two plastic moulds and without the need to separately fit a wiper element to the container. Formation of member 42 and gates 56 on closure 22 involves the use of complex movable mould parts but can readily be accomplished by a person skilled in the art.

It should also be noted that the preceding description relates to a particular preferred embodiment and that many modifications are possible within the broad scope of the invention. For example, the preceding description relates specifically to a mascara container but there is no limitation to this particular type of container, or indeed to cosmetic containers. For example, the invention could be applied to paint containers in which the wand 24 of tho preferred embodiment might be replaced by a paint brush. In other applications, wand 24 or its equivalent might be omitted entirely. For example, a lip-forming member might be inserted into a container for the purpose of restricting pouring of fluent material from the container.

Closure 22 could be designed to be threaded onto the container rather than being designed as a push-fit.

Broadly speaking, it would be possible to apply the invention to a container other than of cylindrical form. Accordingly, the term "annular" as used herein should be broadly interpreted.

We claim:

1. A method of providing an annular lip within a container neck, the method comprising the steps of:

providing a said container, the container including an annular neck portion having an inner wall;

providing a closure for said container, the closure including a plug which is adapted to fit within said container neck portion, an outer closure portion which remains external to the container when the closure is in place, an annular lip-forming member at an inner end of said plug, and breakable coupling means between said lip-forming member and said plug;

said closure being dimensioned with respect to the container neck portion to cause said lip-forming member to form an interference fit with said inner wall of the container neck portion when the plug is fully seated within said neck portion; and, fitting the closure to the container to cause said interference fit between the lip-forming member and the inner wall of the container neck portion;

whereby said coupling means can be subsequently broken to the closure to be removed from the container while leaving the lip-forming fitted within said container neck portion.

2. A method as claimed in claim 1, wherein said closure comprises a one-piece plastic moulding.

3. A method as claimed in claim 2, wherein said breakable coupling means comprises at least one relatively thin and fragile plastic gate extending between said lip-forming member and said plug.

4. A method as claimed in claim 1, comprising a further step after fitting the closure to the container, of twisting the closure with respect to the container to cause said coupling means to break and permit the closure to be removed from the container while leaving the lip-forming member fitting within the container neck portion.

5. A method as claimed in claim 1, wherein said closure is provided with an applicator wand for material within the container, the applicator wand extending from said closure and being encircled by said lip-forming member adjacent said plug, whereby the lip-forming member acts as a wiper for the applicator wand after the lip-forming member has been fitted into said container neck portion.

6. The combination of:

a container which includes an annular neck having an inner wall; and, a closure for said container, the closure including a plug which fits within the container neck portion, an outer closure portion which remains external to the container, an annular lip-forming member at an inner end of the plug, and breakable coupling means between the lip-forming member and the plug;

said closure being dimensioned so that the lip-forming member is an interference fit with the inner wall of the container neck portion when the plug is fully seated within the neck portion so that the lip forming member remains within the container when the closure is removed.

7. The combination as claimed in claim 6, wherein said closure comprises a one-piece plastic moulding.

8. The combination as claimed in claim 7, wherein said breakable coupling means comprises at least one relatively thin and fragile plastic gate extending between said lip-forming member and said plug.

9. The combination as claimed in claim 6, wherein said closure is provided with an applicator wand for material within the container, the applicator wand extending from said closure and being encircled by said lip-forming member adjacent said plug, whereby the lip-forming member acts as a wiper for the applicator wand after the lip-forming member has been fitted into said container neck portion.

10. In the manufacture of a container and closure combination, in which the container includes an annular neck portion having an inner wall;

the improvement comprising:

forming said closure to include a plug which is adapted to fit within said container neck portion, an outer closure portion which remains external to the container when the closure is in place, an annular lip-forming member at an inner end of said plug, and breakable coupling means between said lip-forming member and said plug;

said closure being dimensioned with respect to the container neck portion to cause said lip-forming member to form an interference fit within said inner wall of the container neck portion when the plug is fully seated within said neck portion; and, fitting the closure to the container to cause said interference fit between the lip-forming member and the inner wall of the container neck portion;

whereby said coupling means can be subsequently broken to permit the closure to be removed from the container while leaving the lip-forming member fitted within said container neck portion.

11. A container closure for use with a container including a annular neck portion having an inner wall, said container closure including a plug which is adapted to fit within the container neck portion, an outer closure portion which remains external to the container when the closure is in place, an annular lip-forming member at an inner end of said plug, and breakable coupling means between said lip-forming member and said plug; said closure being dimensioned with respect to the container neck portion to cause said lip-forming member to form an interference fit with said inner wall of the container neck portion when the plug is fully seated within the neck portion.

* * * * *

UNITED STATES PATENT AND TRADEMARK OFFICE

CERTIFICATE OF CORRECTION

PATENT NO. . : 4,947,879

DATED : Aug. 14, 1990

INVENTOR(S) : Costa et al

It is certified that error appears in the above-identified patent and that said Letters Patent is hereby corrected as shown below:

The title page should be deleted to appear as per attached title page.

The sheet of Drawing should be deleted and the enclosed drawing should be added as shown on the attached page.

Signed and Sealed this

Sixteenth Day of June, 1992

*Attest:*

DOUGLAS B. COMER

*Attesting Officer*

*Acting Commissioner of Patents and Trademarks*

United States Patent [19]

Costa et al.

[11] Patent Number: 4,947,879

[45] Date of Patent: Aug. 14, 1990

[54] CONTAINER FOR FLUENT MATERIAL

[75] Inventors: Allan Costa, Old Westbury, N.Y.; Roger Costa, Somerset, Mass.

[73] Assignee: Empire Plastic Packaging, Ltd., Farmingdale, N.Y.

[21] Appl. No.: 334,323

[22] Filed: Apr. 7, 1989

[51] Int. Cl.[5] ..... A45D 40/30

[52] U.S. Cl. ..... 132/218; 132/216; 401/122; 401/129; 215/252; 215/253; 215/363

[58] Field of Search ..... 132/216, 218, 313, 317; 401/121, 122, 126, 129; 215/252, 253, 364

[56] References Cited

U.S. PATENT DOCUMENTS

| | | | |
|---|---|---|---|
| 4,189,245 | 2/1980 | Bennett | 401/126 |
| 4,712,936 | 12/1987 | Kessler | 401/126 |
| 4,733,784 | 3/1988 | Bennett | 401/122 |
| 4,794,936 | 1/1989 | Zango | 132/320 |

*Primary Examiner*—John J. Wilson
*Assistant Examiner*—Frank A. LaViola, Jr.
*Attorney, Agent, or Firm*—Leitner, Greene & Christensen

[57] ABSTRACT

A cosmetic container is provided with an annular lip within the container neck by a method which involves providing a closure for the container which has moulded integrally therewith a lip-forming member. When the closure is fitted to the container, the member forms an interference fit with the inner wall of the container and is retained when the closure is removed. An applicator wand on the closure extends through the annular member and the member acts as a wiper for the wand.

11 Claims, 1 Drawing Sheet

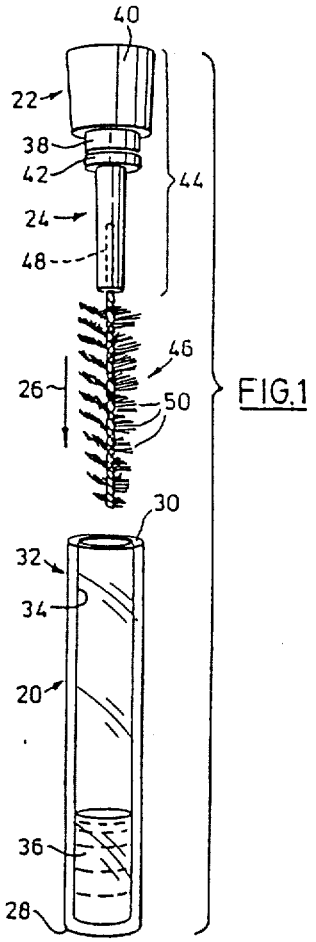

FIG.1

40
22
52
56
56
56
54
42
24
20
48

40
22
38
42
44
24
48
46
26
50
30
32
34
20
36
28

40
22
42
24
20
46
36

40
22
56
54
24
46
42
20